US005351062A

United States Patent [19]

Knapp et al.

[11] Patent Number: 5,351,062

[45] Date of Patent: Sep. 27, 1994

[54] RETRACTABLE DISTRIBUTED ARRAY ANTENNA

[75] Inventors: John R. Knapp, Cazenovia; John D. Reale, Syracuse; Donald P. Miller; David L. Binsley, both of Liverpool, all of N.Y.

[73] Assignee: General Electric Company, Philadelphia, Pa.

[21] Appl. No.: 941,814

[22] Filed: Sep. 8, 1992

[51] Int. Cl.[5] ..... H01Q 1/08

[52] U.S. Cl. ..... 343/880; 343/877; 343/881; 248/436

[58] Field of Search ..... 343/880, 881, 882, 877, 343/915; 248/166, 436; 342/10; 52/645

[56] References Cited

U.S. PATENT DOCUMENTS

| | | | |
|---|---|---|---|
| 1,696,402 | 12/1928 | Horton | 343/877 |
| 2,577,469 | 12/1951 | Kumpf | 250/33 |
| 3,373,434 | 3/1968 | Lorenzo et al. | 343/879 |
| 3,525,483 | 8/1970 | Van Alstyne | 244/1 |
| 3,566,346 | 2/1971 | Scopatz | 343/881 |
| 3,702,481 | 11/1972 | Koller et al. | 343/844 |
| 3,913,109 | 10/1975 | Owen | 343/880 |
| 4,475,323 | 10/1984 | Schwartzberg et al. | 343/881 |
| 4,587,777 | 5/1986 | Vasques et al. | 52/108 |
| 4,651,480 | 3/1987 | Kramer | 52/108 |
| 4,769,647 | 9/1988 | Herbig et al. | 343/915 |
| 4,896,165 | 1/1990 | Koizumi | 343/915 |

FOREIGN PATENT DOCUMENTS

| | | | |
|---|---|---|---|
| 803153 | 5/1980 | South Africa . | |
| 2156029 | 10/1985 | United Kingdom | F16B 7/00 |

*Primary Examiner*—Donald Hajec
*Assistant Examiner*—Tan Ho
*Attorney, Agent, or Firm*—Geoffrey H. Krauss

[57] ABSTRACT

A retractable distributed array antenna has a multiplicity of radiative elements arranged in a beam-forming array of desired configuration and resolvable into a plurality C of columns, with each column having at least one of the antenna radiator elements. Each of a number P of elongated column members, up to but not exceeding C in number, supports the antenna elements of an associated column. The column members are arranged with their elongated dimension generally parallel to one another. The adjacent end portions of each pair of column member, or of a column member and a central stowage module, are joined by a spring-loaded hinge assembly, which urges the joined column member end portions away from each other, to place the columns of elements into the desired distributed array antenna configuration, if no retroactive forces are present. A retraction mechanism, which may use drum-fed drawcables, is provided for controllably drawing the joined column member end portions towards each other, against the action of the hinge spring forces, to collapse the array into a smaller volume than the volume which is occupied by the expanded array.

13 Claims, 4 Drawing Sheets

RETRACTABLE DISTRIBUTED ARRAY ANTENNA

BACKGROUND OF THE INVENTION

The present invention is directed to an antenna for electromagnetic radiation and, more particularly, to a novel distributed array antenna which can be retracted into a volume many times smaller than the volume of the fully-expanded array.

It is well known to form an electromagnetic signal into a beam of radiation for various purposes, e.g. communications, object location and the like; in general, the narrower the radiation beam produced by the antenna (to provide a greater proportion of the radiated power to a specific remote location), the larger the size of the beam-forming antenna. It is often possible to locate a large antenna at a location to which it is impossible to transport the antenna in unitary fashion; some means for forming the final-sized antenna from smaller components is the usual solution to such a transportation problem. However, there are situations where coupling of a plurality of components by human intervention is either not possible or is prohibitive for some reason. In such a situation, it is highly desirable to be able to collapse an antenna into a smaller-than-final volume for transport, and to then deploy the antenna into useable condition at the final location without human intervention. This facility is especially desirable for large distributed array antennae.

BRIEF DESCRIPTION OF THE INVENTION

In accordance with the invention, a retractable distributed array antenna, having a multiplicity of radiative elements arranged in a beam-forming array of desired configuration and resolvable into a plurality C of columns, each having at least one of the antenna radiator elements, includes: a plurality P of elongated column members, up to but not exceeding C in number, each supporting the antenna elements of an associated column and arranged with their elongated dimension generally parallel to one another; a plurality of hinge means, each joining end portions of a pair of juxtaposed column members and adapted for urging the joined column member end portions away from each other, to place the columns of elements into the desired distributed array antenna configuration; and means for controllably drawing the joined column member end portions towards each other, against the action of the hinge means, to collapse the array into a smaller volume than the volume which is occupied by the expanded array.

In present preferred embodiments of our novel deployable antenna, the array may either be of regular element disposition, e.g. an array with elements disposed in regular symmetrical form, as with rectangular symmetry (such as with square-shaped elemental placements), angular symmetry (such as with diamond-shaped elemental placements), circular symmetry, and the like, or may be of irregular element disposition, such as depleted arrays and the like. All arrays will have continuity of RF ground plane preserved, to facilitate achievement of low-sidelobe radiation patterns, and will not require rotary joints and the like complex mechanical arrangements for the folding of any feedlines. The folded "venetian blind" array of our invention may use spring arms, drawcables and the like for urging movement into the open and/or closed positions, to allow relatively simple deployment from a stowed position.

All feed and columnar sections can be fully tested in their final configurations, prior to stowage and deployment, so as to insure trouble-free operation upon deployment of the array. The columns of elements, and their column-bearing members, allow a high degree of part commonality. Accordingly, it is an object of the present invention to provide a novel deployable distributed array antenna.

This and other objects of the present invention will become apparent to the reader upon reading of the following detailed description, when considered in conjunction with the associated drawings.

DETAILED DESCRIPTION OF THE INVENTION

Figure 1A:
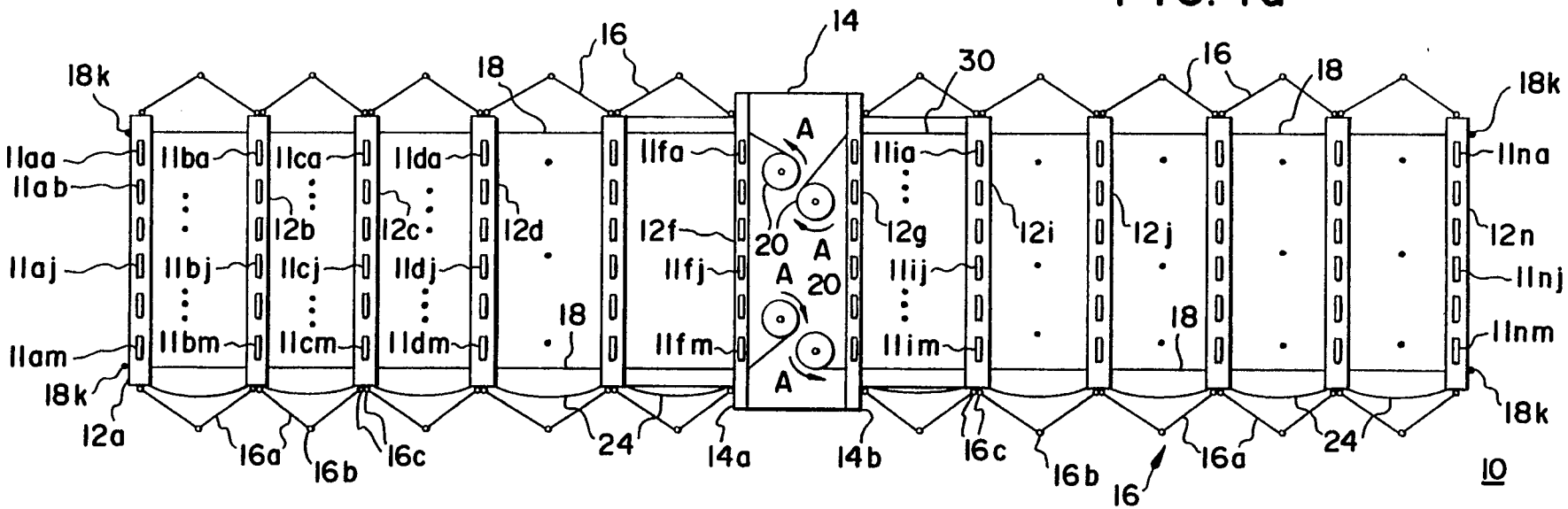
FIG. 1*a* is plan view of one presently preferred embodiment of a deployable distributed array antenna in accordance with the present invention, in the deployed condition.
Figure 1B:
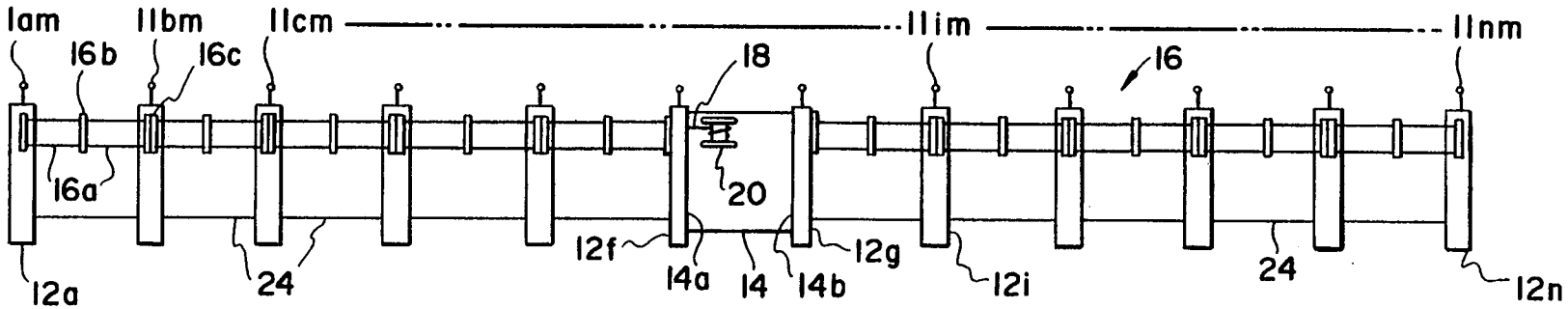
FIG. 1*b* is an end view of the antenna array of FIG. 1*a;*

Referring initially to FIGS. 1*a* and 1*b,* a distributed-aperture array antenna 10 has a multiplicity of radiating elements 11 arranged in a desired configuration, when the array is open and fully deployed for operation. The array is generally placed in a two-dimensional plane, with each element situated at the intersection of one of a plurality C of columns and one of another plurality R of rows. By way solely of illustration, array 11 is rectangular, with each of N columns of elements lying substantially perpendicular to each of M element rows. Thus, any element 11ij is located in the i-th column, where the $a \leqq i \leqq N$ columns are generally vertically emplaced when considering an antenna 10 with its longest array dimension disposed horizontally, and in the j-th row, where the $a \leqq j \leqq M$ row is the j-th element in the i-th column; each of the N columns has the same plurality M of elements (i.e. $a \leqq j \leqq M$). It will be understood that the array may equally as well be an irregular array, of any shape or form known to the antenna art. Similarly, although each radiative element 11 will later be shown as a dipole radiator, for the sake of simplicity, it should be understood that any type of radiative element may be used (single-element radiators, such as dipole or horn, as may multiple-element radiators, such as yagi or log-periodic arrays) at each array location 11ij, in conjunction with the selected array size, shape and other characteristics, to derive the desired end coverage/pattern. The majority of the array elements 11 will be mounted upon an associated one of a plurality N of array columnar members 12*a*–12*n*. The column members 12 are typically positioned with equal number to either side of a central stowage module 14; use of unequal numbers of columns extending from the opposite sides 14*a*/14*b* of the stowage module 14 is possible, although the unequal masses, stresses, etc. associated with unequal side lengths, as well as the unbalanced forces associated with deployment and stowage of such an array, may be undesirable. One or more columns of array elements can be mounted to the central stowage module, or a portion of the module can be configured from one or more column member; as illustrated, column members 12*f* and 12*g*, bearing array elements 11fa–11fm and 11ga–11gm, respectively form a part of one opposite module side 14*a* or 14*b*.

The column members 12 are ideally held parallel to one another, in the rectangular array shown; this configuration obtains from the urging of each column member 12*j* end away from a juxtapositioned end of the adjacent column member 12(j−1) or 12(j+1) or the adjacent central module side 14*a*/14*b*, by one of hinge means 16. Each hinge means 16 contains some apparatus, such as a spring and the like, for supplying the force necessary to urge the column members 12 into the array-deployed open condition, against the force provided by at least one draw cable 18. The amount of deployment of the array is determined by the length of each cable 18, as unwound (e.g. in the direction of arrows A) from at least one storage drum means 20 in the stowage module 14. In the illustrated embodiment, a different one of four different cables is carried on each different one of four drum means 20, and each different cable 18 passes through apertures 22 in an associated different end of a member 12, with a cable retaining formation (such as knot 18*k*) being employed at the outer-most member (12*a* for the right-ward "wing" and 12*n* for the left-ward wing) of the array. It will be seen that it is not necessary to fasten the cable at any but the outer member 12 of a wing, and it is only necessary to provide for low-friction passage of the cable through the non-outermost members of a wing, to allow the cables to draw the members 12 toward the interior of the array, for stowage, and allow the cable to slacken up and allow the members to move away from one another under the deployment forces of the hinge means 16. It should be understood that one drum means 20 can be used for all four cables 18, or individual drum means (as shown) or even a pair of drum means, each controlling the pair of cables for deploying one wing of the array (see, for example, FIG. 1*c*) can be used to provide separate wing movements, if desired. Once the array members 12*a*–12*n* are deployed to their proper positions, a set of column-interconnective RF cables 24 link the columns of array elements; the columns have internal cabling, such that all of the array elements 11 are joined in proper connection to form the desired radiative pattern.

Figure 1C:
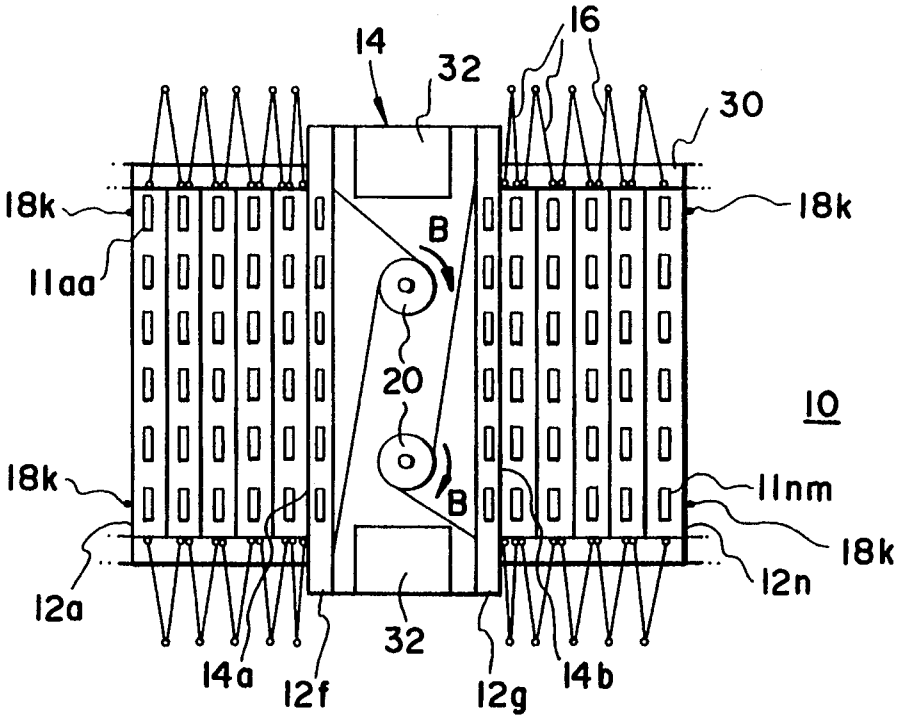
FIG. 1*c* is a plan view of the array antenna in the closed, or stowed, condition.

The array can be closed, to the fully-retracted condition shown in FIG. 1*c*, by causing a suitable drum-rotation mechanism (such as a reversible motor, not shown) to rotate the drums 20 in the opposite direction, e.g. as shown by arrows B, and pull the cable ends 18*k* toward the central module 14, collapsing the hinges means 16 against the spring forces thereof, until each column member 12 is pulled into abutment with adjacent members 14 and/or module sides 14*a*/14*b*. The hinge means, as well as the various RF feedcables 24, bend out of the way of the closing members.

Figure 3A:
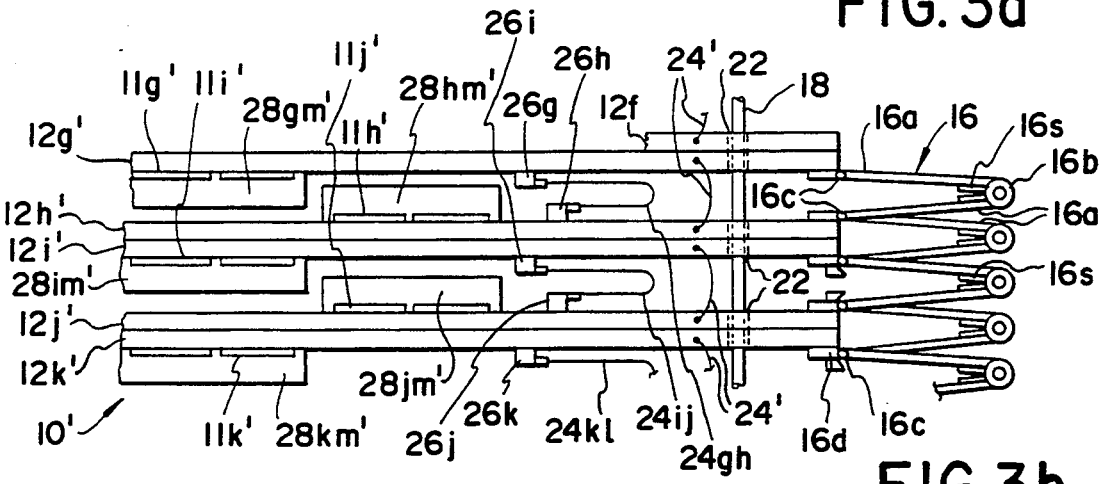
FIGS. 3*a,* 3*b* and 3*c* are end views of a portion of the array respectively in the stowed, partly-open and fully-open conditions, and useful in appreciating the deployment operation of the antenna of the present invention.
Figure 3B:
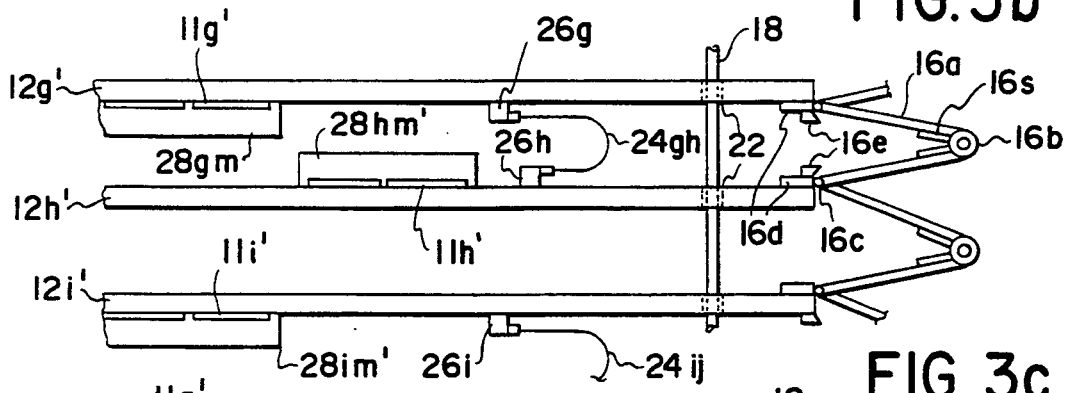
Figure 3C:
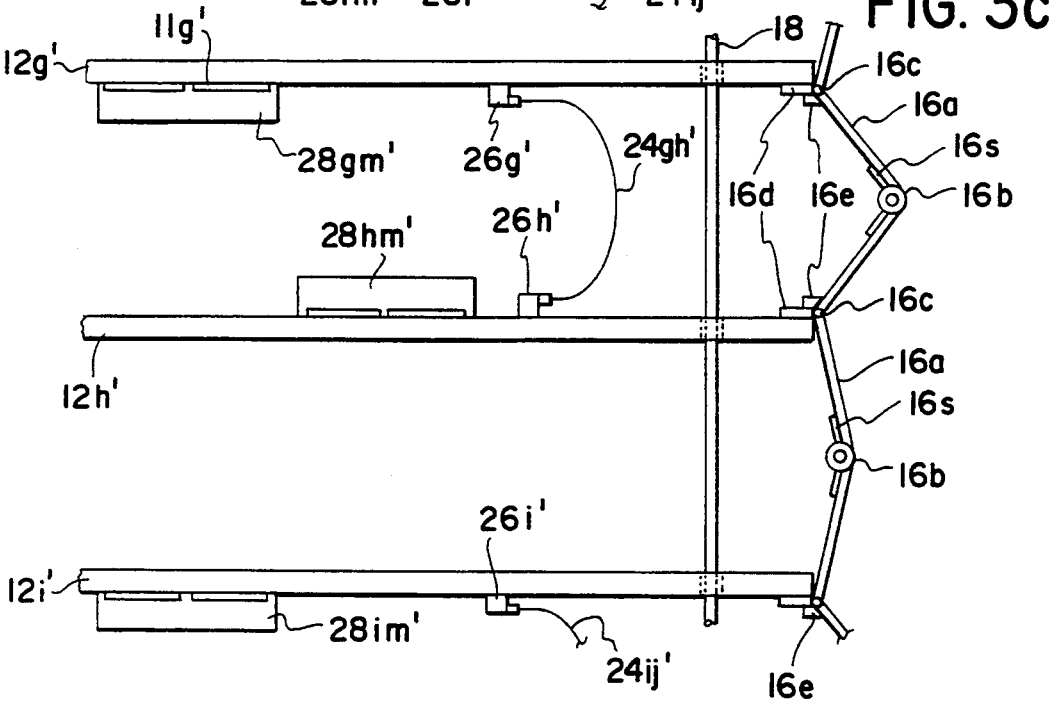

It will be understood that the exact radio-frequency apparatus and feed mechanism details are not shown, being within the knowledge of those skilled in the array antenna art; there will be various common module volumes 32 which can contain the necessary common array apparatus, and each member 12 may, as shown in FIGS. 3*a*–3*c*, carry distributed RF/DC/processing modules, is necessary for the particular form of distributed array selected for carriage on the expandable/retractable antenna.

Figure 2:
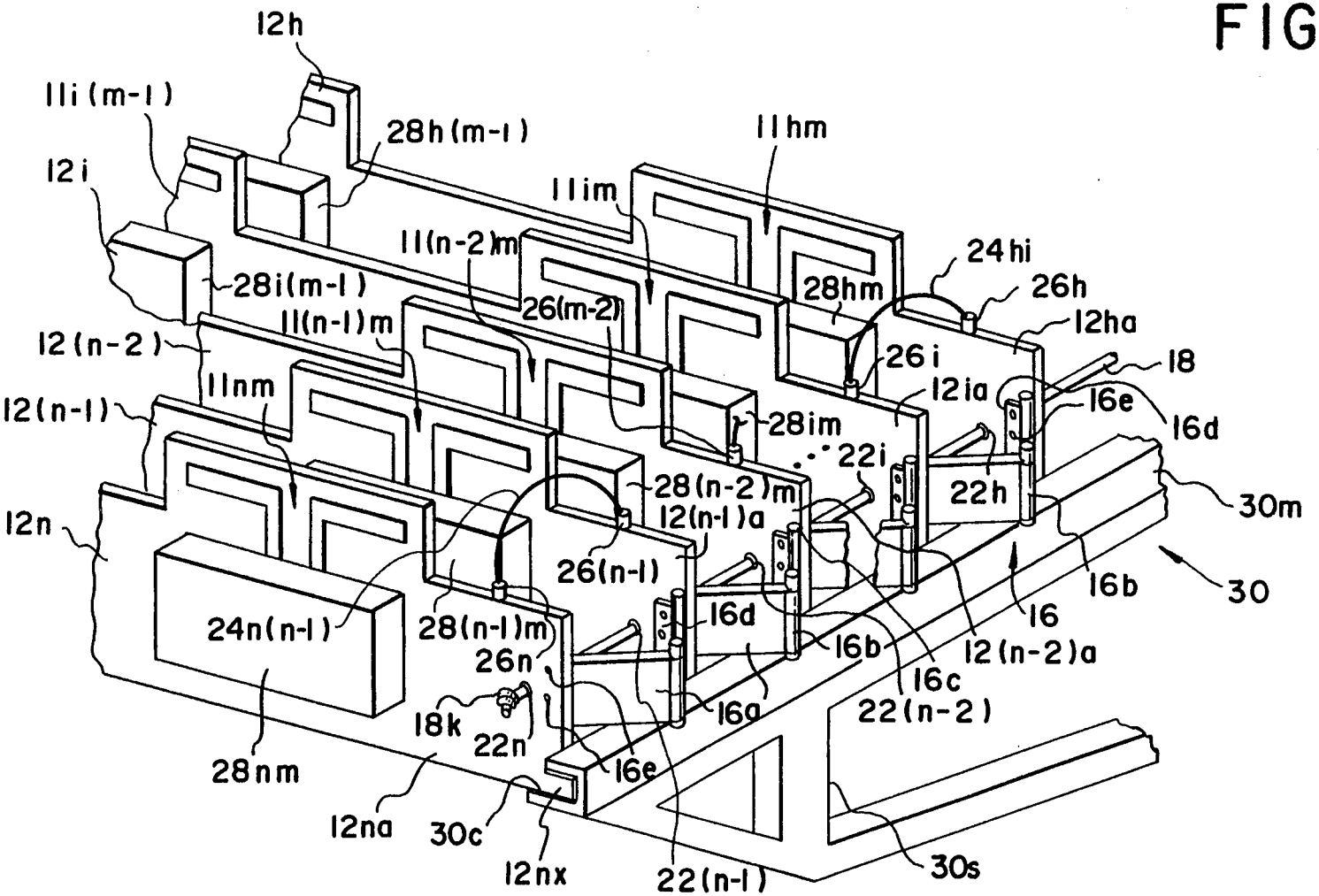
FIG. 2 is a perspective view of a portion of the array, during deployment from the stowed configuration.

Referring now to FIG. 2, it will be seen that each member 12 (with end portions 12ha, 12ia . . . , 12(n−2)a, 12(n−1) and 12na of corresponding members 12*h*, 12*i*, . . . , 12(n−2), 12(n−1) and 12*n* being shown) has an RF connection means 26, to which the RF transmission medium 24 (a coaxial cable, waveguide run and the like) is attached, to facilitate intercolumn electromagnetic energy feeding. Each member 12 may include substantially planar printed circuitry, in microstrip, stripline or other form appropriate for the frequency, power, and the like characteristics of the RF regime to be used. Distributed active and or passive electronics can be housed in each of a plurality of modules 28 mounted on the column member, with each module associated for one radiating array element 11 (as shown) or several such elements. Thus, as here, dipole element 11im, on column member 11*i*, is associated with RF module 28im, while element 11*i*(m−1), on the same member 11*i*, is associated with a different RF module 28*i*(m−1); a previous member 12*h* contains array element 11hm and its associated RF module 11hm. The RF distribution network means (not shown, but known to the art) of the two column members are interconnected by transmission cable 24hi, extending between member 12*h* connector 26*h* and member 12*i* connector 26*i*.

The venetian-blind array of substantially-parallel member 12 is shown in a condition near the stowed-position; the members are still relatively close to one another. If desired, a structural means 30 can be provided so that each member end 12qa, where a≦q≦n, can have a protruding tab portion 12qx contained within and guided by the U-channel 30*c* of a guide member 30*m*, when the column members. Additional supporting structure can also be attached to the stowage module 14, for further stiffening or other reinforcement and the like of the antenna 10.

Referring now to FIGS. 3*a*–3*c*, wherein the antenna array orientation has been rotated by about 90° with respect to the orientation of FIG. 1*a*, it will be seen that column members 12 are now horizontally situated, much like the slats in the venetian window blind from which we take the nickname of our antenna. To further illustrate the versatility of our invention, antenna 10' will, when fully extended and deployed, have its elements arranged along diagonally disposed lines, e.g. with diamond-shaped patterns. This disposition allows the elements (e.g. elements 11*g'*, 11*i'*, 11*k'*, etc.) on every other feedmember (e.g. feedmembers 12*g'*, 12*i'*, 12*k'*, etc.) to be offset from the elements (e.g. 11*h'*, 11*j'*, etc.) on the intermediate feedmembers (e.g. feedmembers 12*h'*, 12*j'*, etc.) and also allows the associated modules on adjacent feedmembers 12 to be on opposite surfaces of those members, whereby the offset modules can, if properly dimensioned, nest in between each other in the array-stowed condition (FIG. 3*a*). The intercolumnar RF cables 24 can be routed to RF connectors located for similar nesting, or can be located for alternate RF cables 24' exiting from the edges of members 12.

The deployment cables 18 are wound about its drum means 20 to the extent necessary to overcome the force of hinge means 16 tending to open the array. Illustratively, hinge means 16 has arm portions extending from a central pivot portion, away from members 12, to other pivot portions mounted on tab portions 16*d* each fastened to one of the associated feed/column members 12. A spring 16*s* may be positioned in pivot portion 16*b* to force arms 16*a* away from each other and so open the array; cable 18 draws against the force of the plurality of springs used in the various sets of hinge means 16 needed to connect the like juxtaposed portions of the members 12. As the drum is allowed to rotate in the array-opening direction, the spring force of the hinge means moves the members 12 apart (as shown in FIG. 3*b*) and even further apart for further pay-out of the cable 18 from its drum means, until a maximum opened condition is reached (FIG. 3*c*). This maximum-open, or deployed, condition may be set in accordance with the action of stop tabs 16*e* on the hinges; this is especially important if the array is to subsequently close under action of drawcables 16—the hinge arms 16*a* must not be allowed to approach the 'flat' or 180° condition, or the proper folding action about center portion 16*b* may not occur and the array will jam open. A further benefit of not allowing the hinge means to fully fold into a flat condition is the ability to absorb shocks or other temporary forces and then return the members 12, and the elements carried thereon, to the desired array configuration, so that the antenna can be used until less-than-ideal conditions.

While several presently preferred embodiments of our novel deployable radiative array antenna have been described in detail herein, many modifications and variations will now occur to those skilled in the art. It is our intent, therefore, to be limited only by the scope of the attached claims and not by way of the details and instrumentalities set forth herein by way of description.

What we claim is:

1. A retractable distributed array antenna, comprising:

a multiplicity of radiative elements arranged in a beam-forming array of desired configuration and resolvable into a plurality C of columns, each having at least one of the antenna radiative elements;

a plurality P, not exceeding C in number, of elongated column members, each supporting the antenna elements of an associated column and arranged with their elongated dimension generally parallel to one another;

a plurality H of hinge means, each joining end portions of a pair of juxtaposed column members and adapted for urging the joined column member end portions away form each other, to place the columns of elements into the desired distributed array antenna configuration, and with at least one of the plurality of hinge means including a pair of arms each having opposed first and second ends, with each first end pivotally mounted to one another and each different arm second end pivotally mounted to different ones of said members, and forcing means, including at least one spring, for urging the second ends of the pair of arms in opposite directions; and means for controllably drawing the joined column member end portions towards each other, against the action of the hinge means, to collapse the array into a smaller volume than the volume occupied by the array when expanded.

2. The antenna of claim 1, wherein each member has first and second opposed end portions, with the first end portions of at least one pair of adjacent members being joined together by a first set of said hinge means, and the second end portions of the same at least one pair of adjacent members being joined together by another set of said hinge means.

3. The antenna of claim 2, wherein said first set and said another set are equal in number.

4. The antenna of claim 3, wherein all of the members have each of its pair of opposed end portions joined to an adjacent end portion of another member by one of said hinge means.

5. The antenna of claim 1, wherein said drawing means includes: at least one draw cable having first and second ends; means for maintaining the cable first end at a member furthest from a designated point in the array; and means for controllably moving the cable first end toward and away from the designated array point to respectively collapse and open the array to the respective stowed and deployed conditions.

6. The antenna of claim 5, wherein said moving means includes at least one drum means for at least reeling out said at least one draw cable to allow said hinge means to open the array.

7. The antenna of claim 6, wherein said at least one drum means is also for reeling in said at least one draw cable to close said array against an opening force of said hinge means.

8. The antenna of claim 7, further comprising a stowage module for housing said drum means.

9. The antenna of claim 8, wherein at least one of said members is attached to said stowage module.

10. The antenna of claim 8, wherein the array includes RF apparatus and the stowage module carries a portion of said RF apparatus.

11. The antenna of claim 10, wherein other portions of said RF apparatus are carried by said members.

12. The antenna of claim 8, wherein said stowage module is located substantially at the center of the array.

13. The antenna of claim 1, wherein the array is a rectangular array having a plurality N of columns, each having the same number M of radiating elements.

* * * * *